United States Patent [19]

Ishii et al.

[11] 4,015,089

[45] Mar. 29, 1977

[54] LINEAR PHASE RESPONSE MULTI-WAY SPEAKER SYSTEM

[75] Inventors: Shinichiro Ishii, Neyagawa; Kanji Kakao, Katano; Takafumi Ueno, Kadoma; Jun Kimura, Kyoto, all of Japan

[73] Assignee: Matsushita Electric Industrial Co., Ltd., Osaka, Japan

[22] Filed: Feb. 17, 1976

[21] Appl. No.: 658,758

[30] Foreign Application Priority Data

Mar. 3, 1975 Japan ..... 50-26239

[52] U.S. Cl. ..... 179/1 E; 179/1 D

[51] Int. Cl.[2] ..... H04R 1/02; H04R 3/14

[58] Field of Search ..... 179/1 D, 1 E

*Primary Examiner*—George G. Stellar

*Attorney, Agent, or Firm*—Stevens, Davis, Miller & Mosher

[57] ABSTRACT

A multi-way speaker system comprising a tweeter, a squawker and a woofer wherein each of the speakers is arranged in staggered relation along their radiating axis at a predetermined spacing from each other and provided with an appropriate crossover network coupled to an input terminal of each of the speaker whereby sound pressure-frequency characteristics of a synthesized sound wave resulting from the synthesis of respective sound waves radiated from respective speakers are rendered flat, and phase frequency characteristics of said synthesized sound wave are rendered linear, over an entire band to improve a waveform transmission characteristic of an overall speaker system.

8 Claims, 12 Drawing Figures

LINEAR PHASE RESPONSE MULTI-WAY SPEAKER SYSTEM

The present invention relates to a multi-way speaker system comprising a woofer, a squawker and a tweeter, and more particularly to a speaker system having flat sound pressure-frequency and linear phase-frequency characteristics to improve a waveform transmission characteristic.

In a prior art multi-way speaker system, a plurality of speakers have been arranged in a plane and constant K-type filters have frequently been used as crossover networks to divide an input audio signal so as to be assigned to a frequency band of each of the speakers. In this type of multi-way speaker system, while it has been designed to have a substantially flat sound pressure-frequency characteristic, a phase-frequency characteristic has not been considered and hence the phase-frequency characteristic has not been linear, resulting in a very poor waveform transmission characteristic. Although a crossover network which assures flat amplitude-frequency and linear phase-frequency characteristics over the entire response range has been proposed from a standpoint of a network, it also has not considered the phase-frequency characteristic of the speakers. Thus, prior art systems have not at all considered making flat both sound pressure-frequency and linear phase-frequency characteristics of the entire speaker system. Another speaker system has been proposed wherein voice coils of the respective speakers are located in the same plane to compensate for delay time, but since this system has also not considered the phase characteristic of the speakers and the phase characteristic of the crossover networks, it could not provide a linear phase characteristic of an overall speaker system.

In the light of the above problems encountered in the prior art system, it is an object of the present invention to consider the phase of the speaker and the propagation time of sound wave radiated from the speaker and to provide a multi-way speaker system having flat sound pressure-frequency and linear phase-frequency characteristics and an improved waveform transmission characteristic.

These and other objects, features and advantages of the present invention will become more apparent from the following detailed description of preferred embodiments of the invention when taken in conjunction with the accompanying drawings, in which.

Figure 1:
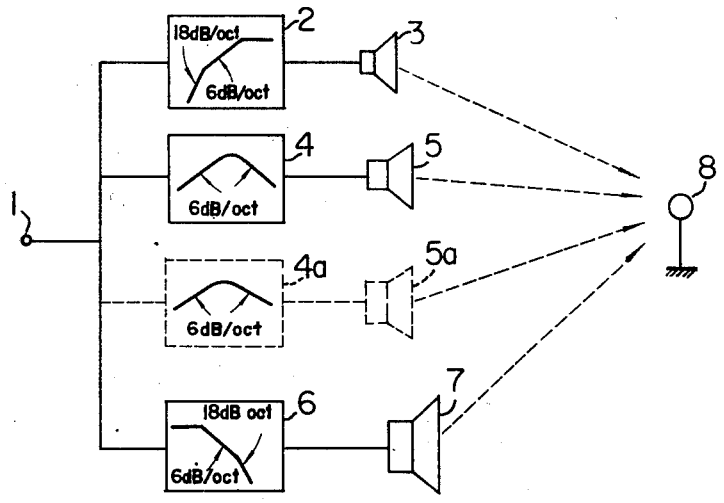
FIG. 1 is a block diagram showing a multi-way speaker system in accordance with one embodiment of the present invention.

FIG. 1 shows a multi-way speaker system in accordance with one embodiment of the present invention. An audio signal applied to an input terminal 1 is divided into high frequency range, medium frequency range and low frequency range through a high pass filter 2 having a 18 dB/oct slope at a lower frequency, a band pass filter 4 having a single resonance characteristic and a low pass filter 6 having a 18 dB/oct slope at a higher frequency, respectively. High frequency range component of the input audio signal derived through the high pass filter 2 is fed to a high frequency speaker or tweeter 3, medium frequency component derived through the band pass filter 4 is fed to a medium frequency speaker or squawker 5, and low frequency component derived through the low pass filter 6 is fed to a low frequency speaker or woofer 7. Sound waves radiated from the speakers 3, 5 and 7 are added together, by a microphone 8 located at a listening area in front of the speakers 3, 5 and 7.

Figure 2:
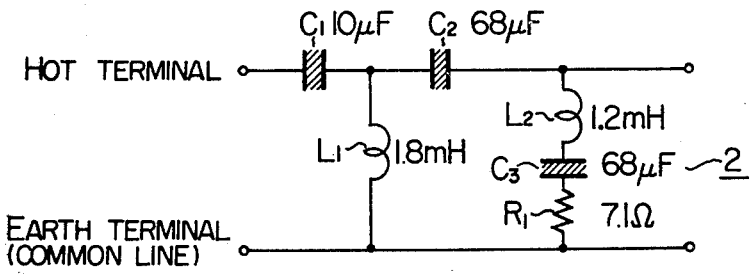
FIG. 2 is a circuit diagram showing a high pass filter and an impedance compensation circuit compensating impedance characteristic used in the above system.
Figure 3:
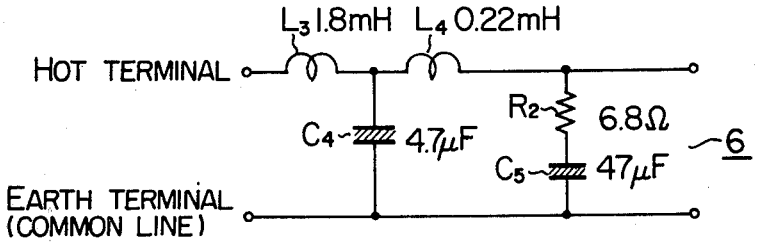
FIG. 3 is a circuit diagram showing a low pass and an impedance compensation circuit compensating impedance characteristic used in the above system.
Figure 4:
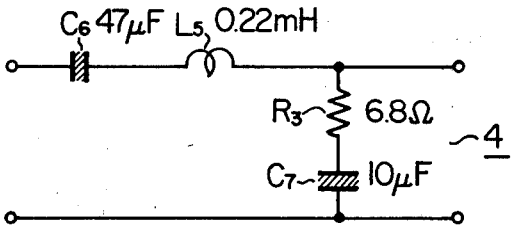
FIG. 4 is a circuit diagram showing a band pass filter and an impedance compensation circuit compensating an impedance characteristic used in the above system.

The high pass filter 2 and the low pass filter 6 each comprises, as shown in FIGS. 2 and 3, a main filter of 6 dB/oct slope and an auxiliary filter of 12 dB/oct slope stagger connected thereto to exhibit 6 dB/oct slope near a cutoff frequency in a stop band and 18 dB/oct slope in a range away from the cutoff frequency in the stop band. In FIG. 2, capacitors $C_1$ and $C_2$ and an inductor $L_1$ constitute a high pass filter and in FIG. 3 inductors $L_3$ and $L_4$ and a capacitor $C_4$ constitute a low pass filter. In either case, resonance sharpness Q at a cutoff frequency of the auxiliary filter is set to be equal to or larger than 0.7. The band pass filter 4 comprises, as shown in FIG. 4, a filter circuit having a single resonance characteristic including a capacitor $C_6$ and an inductor $L_5$. In FIGS. 2 to 4, $L_2$, $C_3$, $R_1$; $R_2$, $C_5$; and $R_3$, $C_7$ are impedance compensation circuits for compensting impedance characteristics of the speakers 3, 7 and 5 so as to make their apparent characteristic flat.

Figure 8:
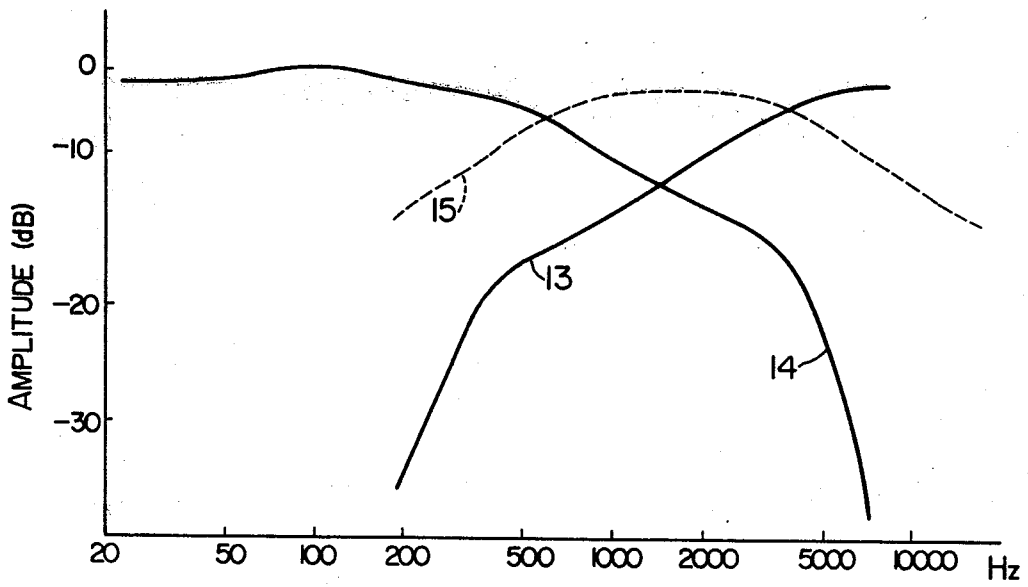
FIG. 8 shows particular frequency characteristics of the crossover networks used in the above system.

FIG. 8 shows frequency characteristics at outputs of the high, low and band pass filter 2, 6 and 4 shown in FIGS. 2 to 4 when they are connected as shown in FIG. 1 and the audio signal is applied to the input terminal 1. As seen from FIG. 8, an amplitude characteristic curve 13 for the high pass filter 2 shows approximately 6 dB/oct slope in the frequency range of 3.8 $KH_z$ to 400 $H_z$ and approximately 18 dB/oct slope below the frequency of 400 $H_z$. On the other hand, an amplitude characteristic curve 14 of the low pass filter 6 shows approximately 6 dB/oct slope in the frequency range of 600 $H_z$ to 4 $KH_z$ and approximately 18 dB/oct slope above the frequency of 4 $KH_z$. The frequency characteristic curves 13 and 14 for the high pass filter 2 and the low pass filter 6 cross at approximately 1.5 $KH_z$. The band pass filter 4, on the other hand, resonate at 1.6 $KH_z$ and Q of the band pass filter 4 is approximately 0.4.

Figure 5:
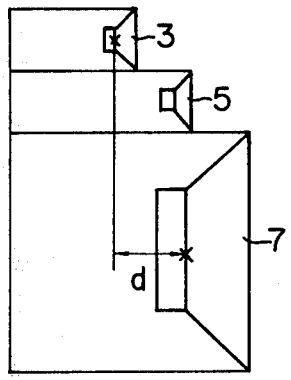
FIG. 5 is a schematic diagram illustrating an arrangement of the speakers in the above system.
Figure 6:
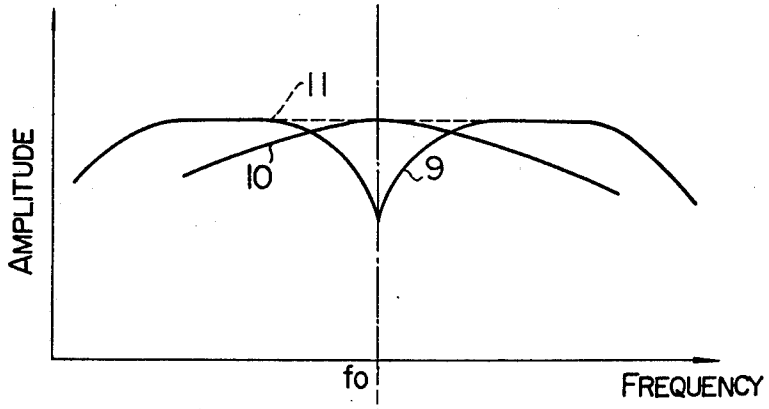
FIGS. 6 and 7 show a sound pressure-frequency characteristic and a phase-frequency characteristic illustrating adjusting operation of the above system.
Figure 7:
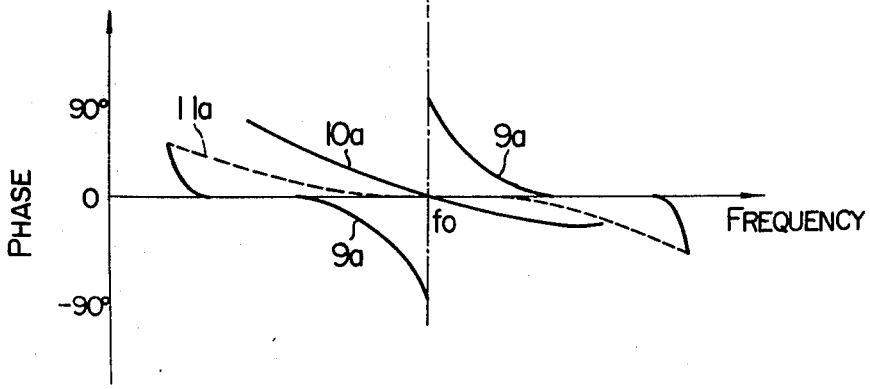

Referring now to FIGS. 5 to 7, a particular method for making the sound pressure-frequency flat and the phase-frequency characteristics linear by the high, low and band pass filters 2, 4 and 6 and the speakers 3, 5 and 7, is described. In the present embodiment, the tweeter 3 comprises a 3.2 cm dome-type speaker, the squawker 5 comprises a 12 cm cone-type speaker and the woofer 7 comprises a 35 cm cone-type speaker.

First, in accordance with a method to be described later, the location of the tweeter 3 is stepped to the rear with respect to the woofer 7 such that the phases of the sound waves from the tweeter 3 and the woofer 7 responsive to the audio signal applied to the input terminal 1 are reverse at the frequency $f_o$ in the center of the overlap region of the sound pressure-frequency characteristics for the tweeter 3 and the woofer 7 (hereinafter referred to as the center frequency). The sound waves thus radiated from the speakers 3 and 7 are synthesized so that a sound pressure-frequency of the synthesized sound wave has a null at the center frequency $f_o$, and thus said sound pressure-frequency has a band stop characteristic. The band stop characteristic herein used means a characteristic as shown by a solid line 9 in FIG. 6 wherein the location of the tweeter 3 and the woofer 7 as well as the parameters of the high and low pass filter 2 and 6 are adjusted such that a null appears at the center frequency $f_o$, and the phase-frequency characteristic curve approaches zero degree except near the center frequency $f_o$ as shown by a solid line 9a in FIG. 7 and at the same time the phase angle lies within about 90°.

The adjustment of the location of the speakers to attain the above band stop characteristic is now described. As stated above, the speakers are arranged such that the phases of the sound waves radiated from the tweeter 3 and the woofer 7 responsive to the audio signal applied to the input terminal 1 are reverse at the location of the microphone 8 whereby the band stop characteristic appears in the sound pressure-frequency characteristic of the sound wave synthesized from the sound waves radiated from the tweeter 3 and the woofer 7. In this case, if the tweeter 3 and the woofer 7 were arranged in the same plane, a phase difference between the sound waves from the tweeter 3 and the woofer 7 would most frequently be larger than 180°. In accordance with the present invention, as shown in FIG. 5, an acoustic center of the tweeter 3 is stepped to the rear by d cm from an acoustic center of the woofer 7. By locating the acoustic center of the tweeter 3 $d$ cm rearwardly from the location of the microphone 8 shown in FIG. 1 than the accoustic center of the woofer 7, the phase of the sound wave from the woofer 7 leads by the following amount with respect to the phase of the sound wave from the tweeter 3 at the center frequency $f_o$ ($H_z$), $$\frac{360 \times f_o \times d}{V} \text{ degrees}$$

where V is a sound velocity (cm/sec).

Accordingly, the stepping back the tweeter 3 from the woofer 7 and adjusting the distance $d$ in the above formula, the phase difference can be adjusted to 180° to attain the band stop characteristic.

On the band stop characteristic thus obtained, a characteristic of the sound wave radiated from the squawker 5 is superimposed so that the sound pressure-frequency and phase-frequency characteristics of the overall system can be flattened. Referring to FIG. 7, if the squawker 5 is located such that a phase-frequency characteristic 10a for the squawker 5 responsive to the audio signal applied from the input terminal 1 is laid at the center of the phase-frequency characteristic 9a of the band stop characteristics, with a separation of about 90° therefrom, then the phase-frequency characteristic of the overall system is made flat over an entire range as shown by a broken line 11a in FIG. 7. The sound pressure-frequency characteristic of the overall system is also made flat over the entire range as shown by a broken line 11 in FIG. 6. In this case, as shown in FIG. 5, by arranging the squawker 5 in front of the tweeter 3, the phase difference between the sound waves from the squawker 5 and the tweeter 3 can be decreased and the synthesis is facilitated.

Figure 9:
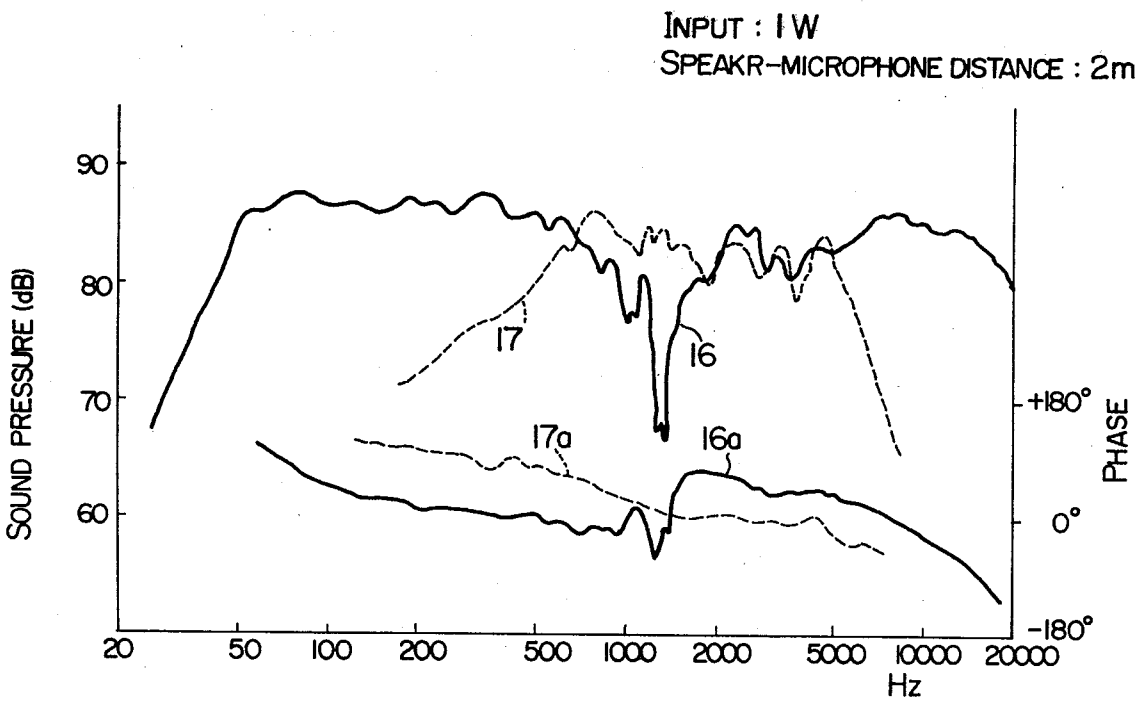
FIG. 9 shows sound pressure-frequency and phase-frequency characteristics which have been actually measured in the above system.
Figure 10:
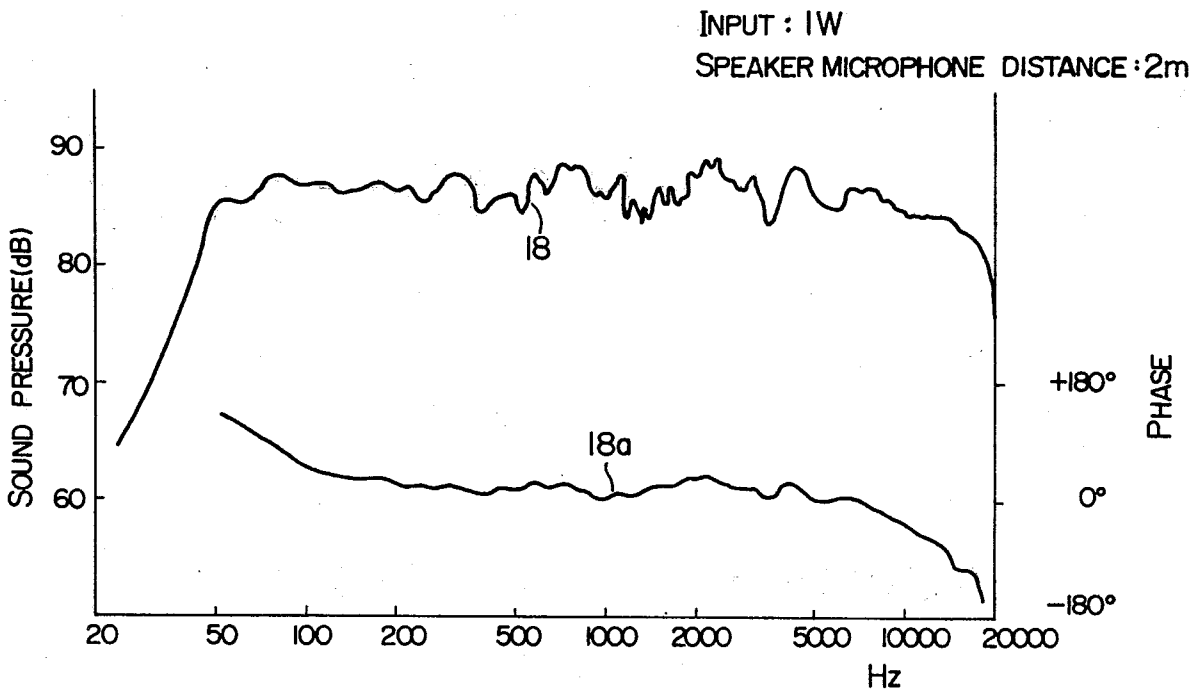
FIG. 10 shows overall sound pressure-frequency and phase-frequency characteristics of the above system.

FIGS. 9 and 10 show frequency characteristics actually measured in the present embodiment. The high, low and band pass filter 2, 4 and 6 shown in FIGS. 2 to 4, and the tweeter 3 consisting of a 3.2 cm dome-type speaker, the squawker consisting of a 12 cm cone-type speaker and the woofer consisting of a 35 cm cone-type speaker were connected as shown in FIG. 1, and the tweeter 3 was stepped back by 13.5 cm from the woofer 7. The resulting sound pressure-frequency characteristic of the sound wave synthesized from the sound waves radiated from the tweeter 3 and the woofer 7 is shown by a curve 16 in FIG. 9 while the phase-frequency characteristic thereof is shown by a curve 16a in FIG. 9. A sound pressure-frequency characteristic of the sound wave radiated from the squawker 5 when it is displaced forwardly by 3.5 cm from the tweeter 3 is shown by a curve 17 in FIG. 9 while a phase-frequency characteristic thereof shown by a curve 17a in FIG. 9. The band stop characteristics 16 and 16a in FIG. 9 and the characteristics 17 and 17a for the sound wave radiated from the squawker 5 were added together to obtain the frequency characteristics of the overall speaker system. The sound pressure-frequency characteristic thereof is shown by a curve 18 in FIG. 10 while the phase-frequency characteristic is shown by a curve 18a in FIG. 10. It is obvious from FIGS. 9 and 10 that the sound pressure-frequency and phase-frequency characteristics 16, 17, 18, 16a, 17a, and 18a are similar to the sound pressure-frequency and phase-frequency characteristics shown in FIGS. 6 and 7 and the sound pressure-frequency characteristic is flat and the phase frequency characteristic is linear over the entire range.

Figure 11:
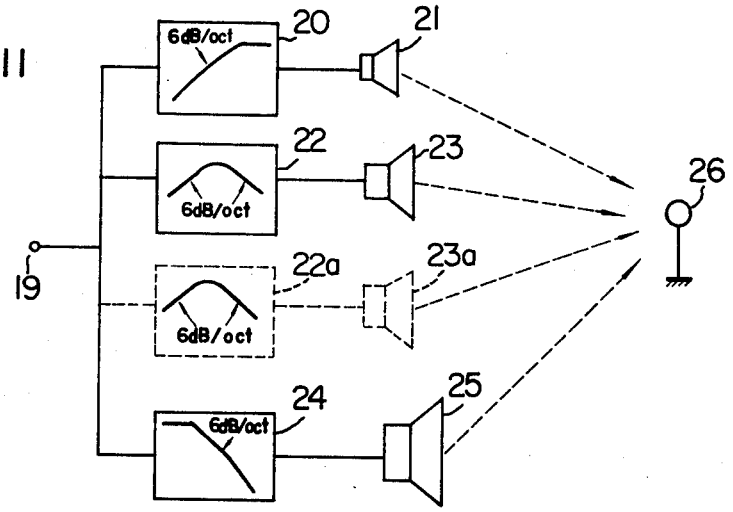
FIG. 11 is a block diagram showing a multi-way speaker system in accordance with a second embodiment of the present invention.

FIG. 11 shows a second embodiment of the present invention. In FIG. 11, an audio signal applied to an input terminal 19 if fed to a tweeter 21 though a high pass filter 20 having 6 dB/oct slope in the stop hand, to a squawker 23 through a band pass filter 22 having a single resonance characteristic, and to a woofer 25 through a low pass filter 24 having 6 dB/oct slope in the stop band. The sound waves radiated from the speakers 21, 23 and 25 are added together by a microphone 26 located at a listening area in front of the speakers 21, 23 and 25.

In this embodiment, as in the first embodiment, the tweeter 21 is stepped back from the woofer such that the phases of the sound waves radiated from the tweeter 21 and the woofer 25 responsive to the audio signal applied to the input terminal 19 are reverse at the location of the microphone 26 to create a band stop characteristic around the center frequency $f_o$ on the sound pressure-frequency characteristic of the sound wave synthesized from the sound waves radiated from the speakers 21 and 25.

The squawker 23 is also arranged in the same manner as described in the first embodiment so that the sound pressure-frequency characteristic of the overall speaker system is made flat and the phase frequency characteristic of the overall speaker system is made linear over an entire range.

The present embodiment differs from the first embodiment in that the low pass filter and the high pass filter comprise filters having 6 dB/oct slope in the stop band instead of 18 dB/oct slope in the stop band. Since the filters having 18 dB/oct slope in the stop band used in the first embodiment show high resonance sharpness Q (Q >0.7) at the cutoff frequency of the filters having 12 dB/oct slope used as auxiliary filters, the phase-shift at $f_o$ caused by the auxiliary filters is negligible, so the same method as in the first embodiment may be used in synthesizing the sound waves from the tweeter 21, squawker 23 and woofer 25.

Figure 12:
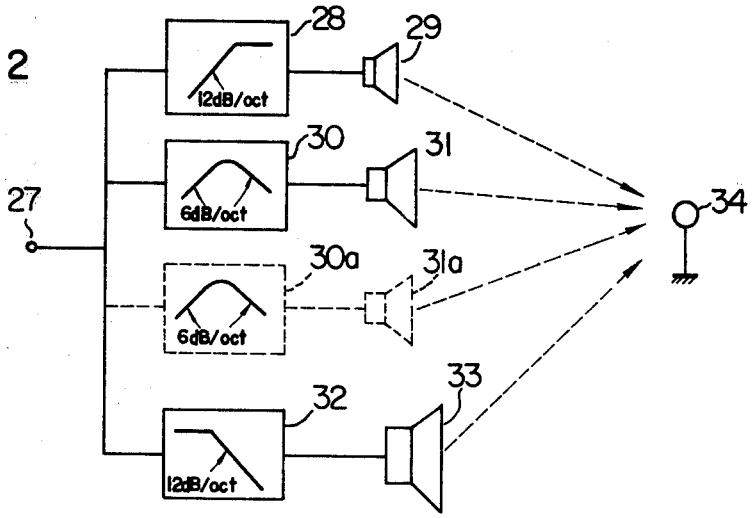
FIG. 12 is a block diagram showing a multi-way speaker system in accordance with a third embodiment of the present invention.

FIG. 12 shows a third embodiment of the present invention. In FIG. 12, an audio signal applied to an input terminal 27 is fed to a tweeter 29 through a high pass filter 28 having 12 dB/oct slope in the stop band, to a squawker 31 through a band pass filter 30 having a single resonance characteristic, and to a woofer 33 through a low pass filter 32 having 12 dB/oct slope in the stop band. The sound waves radiated from the speakers 29, 31 and 33 are added together by a microphone 34 located at a listening area in front of the speakers 29, 31 and 33.

The tweeter 29 is stepped back from the woofer 33 such that the phases of the sound waves radiated from the tweeter 29 and the woofer 33 responsive to the audio signal applied to the input terminal 27 are reverse at the location of the microphone 34 to create a band stop characteristic around the center frequency $f_o$ on the sound pressure-frequency characteristic of the resultant sound wave synthesized from the sound waves radiated from the tweeter 29 and the woofer 33.

The squawker 31 is also arranged in the same manner as in the first embodiment so that the sound pressure-frequency characteristic of the overall speaker system is made flat and the phase frequency characteristic of overall speaker system is made linear over an entire range.

The present embodiment differs from the first embodiment in that the low pass filter and the high pass filter comprise filters having 12 dB/oct slope in the stop band instead of 18 dB/oct slope in the stop band. In this case, when the resonance sharpness Q of the 12 db/oct slope filter at the cutoff frequency is selected to be low (experimentarily Q≅0.5), the 12 dB/oct slope filter exhibits an attenuation characteristic near the cutoff frequency which is very similar to that of the filter of the first embodiment. The operation of the crossover networks in the present invention is thus substantially identical to that in the first embodiment, and a similar method as in the first embodiment may be employed in synthesizing the sound waves from the tweeter 29, the squawker 31 and the woofer 33.

In the first, second and third embodiments it has been described that the squawker is arranged such that the phase-frequency characteristic of the sound wave radiated from the squawker is laid substantially at the center of the phase-frequency characteristic of the sound wave synthesized from the sound waves radiated from the woofer and the tweeter with a separation of approximately 90° therefrom. The separation of 90° is not always necessary but practically satisfactory effect can be obtained so long as the system is adjusted such that the former characteristic is laid at the center of the latter characteristic.

In any of the above embodiments, when a sufficiently flat frequency characteristic cannot be attained by one set of medium band pass filter 4, 22 or 30 and squawker 5, 23 or 31, an additional set of medium range branching filter **4*a*, 22*a* or 30*a* and squawkers 5*a*, 23*a* or 31*a* may be added as shown by broken lines in FIGS. 1, 11 and 12**. In this case, the two squawkers are arranged such that the phase-frequency characteristics for the sound waves radiated from the two squawkers show a phase difference of approximately 90° in the center of the overlap region of the sound pressure-frequency characteristics for the two squawkers, and the phase-frequency characteristic of the sound wave synthesized from the sound waves radiated from the two squawkers is laid substantially at the center of the phase-frequency characteristic of the sound wave synthesized from the sound waves radiated from the tweeter and the woofer with the separation of approximately 90° therefrom. With this arrangement, the sound pressure-frequency characteristic of the overall speaker system can be made flat and the phase-frequency characteristic of the overall speaker system can be made linear over an entire range.

What is claimed is:

1. A multi-way speaker system comprising a low pass filter, a high pass filter each having a predetermined slope in the stop band and a band pass filter having a single resonance characteristic each for dividing an input audio signal to predetermined frequency bands, and a woofer, a tweeter and a squawker each connected to an output terminal of said low pass filter, said high pass filter and said band pass filter respectively, said tweeter being stepped back from said woofer such that when said woofer and said tweeter are driven by outputs of said low pass filter and said high pass filter the phases of sound waves radiated from said woofer and said tweeter are reverse at a listening area in front of said woofer, said tweeter and said squawker at the center frequency in the overlap region of the sound pressure-frequency characteristics for said woofer and said tweeter, said squawker being arranged such that when said squawker is driven by an output from said band pass filter a phase-frequency characteristic of sound wave radiated from said squawker, at said listening area, is laid substantially at the center of a phase-frequency characteristic of the sound wave synthesized from sound waves radiated from said tweeter and said woofer.

2. A multi-way speaker system according to claim 1 wherein said band pass filter exhibits a single resonance characteristic having a resonant point at a frequency substantially equal to the crossover frequency of said low pass filter and high pass filter, said squawker being arranged such that the phase-frequency characteristic of the sound wave radiated from said squawker, at said listening area, is laid substantially at the center of the phase-frequency characteristic of the sound wave synthesized from the sound waves radiated from said woofer and said tweeter with the separation of approximately 90° therefrom.

3. A multi-way speaker system according to claim 1 further comprising an additional band pass filter having a single resonance characteristic and an additional squawker connected to an output terminal of said additional band pass filter.

4. A multi-way speaker system according to claim 3 wherein said two squawkers are arranged such that phase-frequency characteristics of sound waves radiated from said two squawkers at a listening area in front of said woofer, said tweeter and said two squawkers show a phase difference of approximately 90° at the center frequency in the overlap region of the sound pressure-frequency characteristics of sound waves radiated from said two squawkers,and a phase-frequency characteristic of a synthesized sound wave synthesized from the sound waves radiated from said two squawkers is laid substantially at the center of the phase-frequency characteristic of the sound wave synthesized from the sound waves radiated from the woofer and the tweeter with a separation of approximately 90° therefrom.

5. A multi-way speaker system according to claim 1 wherein said low pass filter and said high pass filter exhibit 18 dB/oct slope in the stop band.

6. A multi-way speaker system according to claim 1 wherein said low pass filter comprises an inductor connected in series with an input terminal, a capacitor connected between an output terminal of said inductor and a common line, and an inductor connected between the output terminal of said first inductor and an input terminal of the woofer, and has a 6 dB/oct slope near a cutoff frequency in the stop band and a 18 dB/oct slope at the high extremity, said high pass filter comprises a capacitor connected in series with the input terminal, an inductor connected between an output terminal of said capacitor and a common line and a capacitor connected between the output terminal of the first capacitor and an input terminal of the tweeter, and has a 6 dB/oct slope near a cutoff frequency in the stop band and a 18 dB/oct slope at the low extremity, and said band pass filter comprises a capacitor and an inductor connected in series between the input terminal and an input terminal of the squawker.

7. A multi-way speaker system according to claim 1 wherein said low pass filter and said high pass filter exhibit a 6 dB/oct slope in the stop band.

8. A multi-way speaker system according to claim 1 wherein said low pass filter and said high pass filter exhibit a 12 dB/oct slope in the stop band.

* * * * *